US008167023B2

(12) United States Patent
Renkel

(10) Patent No.: US 8,167,023 B2
(45) Date of Patent: May 1, 2012

(54) APPARATUS FOR CENTRIFUGAL CASTING UNDER VACUUM

(76) Inventor: Manfred Renkel, Bad Staffelstein (DE)

( * ) Notice: Subject to any disclaimer, the term of this patent is extended or adjusted under 35 U.S.C. 154(b) by 351 days.

(21) Appl. No.: 12/310,918

(22) PCT Filed: Oct. 22, 2007

(86) PCT No.: PCT/EP2007/009138

§ 371 (c)(1),
(2), (4) Date: May 8, 2009

(87) PCT Pub. No.: WO2008/049564

PCT Pub. Date: May 2, 2008

(65) Prior Publication Data

US 2009/0321038 A1 Dec. 31, 2009

(30) Foreign Application Priority Data

Oct. 23, 2006 (WO) ..... PCT/EP2006/010192
Dec. 15, 2006 (WO) ..... PCT/EP2006/012092

(51) Int. Cl.
*B22D 13/06* (2006.01)
*B22D 13/12* (2006.01)

(52) U.S. Cl. ..... 164/289; 164/286; 164/292

(58) Field of Classification Search ..... 164/286, 164/289–290
See application file for complete search history.

(56) References Cited

U.S. PATENT DOCUMENTS 2,450,832 A * 10/1948 Kuhlman ..... 164/513
4,027,719 A * 6/1977 Strempel ..... 164/493
4,510,987 A * 4/1985 Collot ..... 164/71.1
4,762,165 A * 8/1988 Ogino et al. ..... 164/457
5,223,278 A * 6/1993 Nicetto ..... 425/150
6,706,322 B2 * 3/2004 Tateyama et al. ..... 427/240
2001/0045267 A1 11/2001 Choudhury et al.
2007/0267165 A1 * 11/2007 Monteiro et al. ..... 164/65

FOREIGN PATENT DOCUMENTS

GB 647019 A 12/1950

(Continued)

OTHER PUBLICATIONS

XP-002463839, pp. 144-146; "Development of a new centrifugal Investment casting process for the production of small, thin section and filigree castings of titanium and titanium alloys" vol. 43, No. 4, 1991, pp. 141-161.

(Continued)

*Primary Examiner* — Jessica L Ward
*Assistant Examiner* — Jacky Yuen
(74) *Attorney, Agent, or Firm* — Manabu Kanesaka

(57) ABSTRACT

An apparatus for centrifugal casting under vacuum includes a rotor having a shaft extending in an essentially vertical direction and being rotatable around an axis defined by the shaft. The rotor has at least one mold, at least one crucible, and a gas-tight housing in which the mold and the crucible are accommodated. The apparatus also includes a vacuum source to create a vacuum in the housing, a heating device that melts a metal, a drive device that drives the shaft in order to rotate the rotor, and an auxiliary acceleration device configured to generate a force to further rotate the rotor to overcome a moment of inertia of the rotor. The auxiliary acceleration device includes a jet propulsion and/or at least one pushing actuator accelerating the resting rotor.

15 Claims, 5 Drawing Sheets

FOREIGN PATENT DOCUMENTS

RU 2 056 971 C1 3/1996

OTHER PUBLICATIONS

XP-002463842; "High Tech for precision fine casting" Jewellery-Medical technics-Automobil-Aviation/Space flight; Titanium precision casting; Heart treatment of gemstones; Linn High Therm Catalogue, [online] 2000, pp. 1-12, Eschenfelden, Germany; Retrieved from the Internet: URL:http://neu.linn.de/docs/juwellery.pdf>; [retrieved on Jan. 9, 2008], p. 1-5.

XP-002463843; TiAl-precision casting; Linn High Therm Publication, [online] 2000; Eschenfelden, Germny; Retrieved from the Internet: URL:http//www.linn-high-therm.de/images/stories/pdf/Tial_E.pdf>; [retrieved on Jan. 9, 2008] pp. 1-2.

XP-002463840 p. 297, figure 1; "X-ray tomographic imaging of Al/SiCp functionally graded composites fabricated by centrifugal casting", A. Velhinho [a,b], P.D.Sequeira [c], Rui Martins [a], G. Vignoles [d], F. Braz Fernandes [a,b], J.D.Botas [b], L.A. Rocha [c,e]; Nuclear Instruments and Methods in Physics Research, vol. 200, 2003, pp. 295-302.

XP-002463841, p. 310; "Numerical simulation of porosity-free titanium dental castings", Wu M, Augthum M, Schädlich-Stubenrauch J, Saham PR, Spiekermann H.; European Journal of Oral Sciences, 1999, pp. 307-315.

* cited by examiner

APPARATUS FOR CENTRIFUGAL CASTING UNDER VACUUM

BACKGROUND OF THE INVENTION

The invention pertains to an apparatus for centrifugal casting under vacuum, in particular for the production of castings made of titanium aluminides.

RU 2 056 971 C1 as well as GB 647 019 A describe centrifugal casting machines having an auxiliary acceleration device for generating a force to overcome a moment of inertia of a rotor. However, both machines are not suitable for carrying out a centrifugal casting process under vacuum.

US 2001/0045267 A1 describes an apparatus for centrifugal casting under vacuum. In the known apparatus a first crucible and a rotor are accommodated within a gas-tight vacuum chamber. A melt being taken up in a first crucible is poured into a second crucible or gate, respectively, which is part of the rotor which can be rotated around a vertical axis. The gate has a plurality of radial outlet openings opposite of which there are arranged inlet openings of molds extending in a radial direction. The melt being poured into the gate is forced by centrifugal forces through the outlet openings thereof into the molds. By use of this apparatus castings with a simple geometrical shape like valves for internal combustion engines and the like can be produced.

However, when producing castings from titanium aluminides or titanium grade 2 having thin walls and a complex geometry, e.g. shrouded turbine blades or turbo charges wheels, one is encountered with several problems, like the formation cold-runs, hot tears, shrinkholes, pores, voids and the like.

SUMMARY OF THE INVENTION

It is an object of the present invention to overcome the disadvantages in the art. According to an aim of the invention there shall be provided an apparatus for centrifugal casting by which castings having a complicated geometry can be cast with an improved quality. According to a further aim of the invention by the proposed apparatus a production of high-quality castings made of titanium aluminides shall be possible.

This object is solved by the features of claim 1. Advantageous embodiments of the invention are described by the features of claim 2 to 17.

In the sense of the present invention under a "crucible" there is in general understood a container which has sufficient heat resistance to take up a metallic melt without being damaged and without undergoing reactions with the melt. A "crucible" in the sense of the present invention may have any suitable shape. In particular it may have the shape of a cylinder the bottom of which has a rounded concave shape. However, a "crucible" in the sense of the present invention may also be formed as ring-like channel. Suitable materials for the production of a crucible are alumina, $Y_2O_3$, magnesia, silica-glass, graphite and the like.

According to one aspect of the invention there is provided an auxiliary acceleration device for generating a force to overcome a moment of inertia of the rotor.—By the proposed feature it is possible to rapidly accelerate the rotor within a short time to a high rotational speed. Due to the acting centrifugal forces the melt is rapidly forced at a high temperature into the mold. Thereby the porosity of castings is lowered.

According to further aspect of the invention the rotor comprises a gas-tight housing in which the mold and the crucible are accommodated. By this feature the volume to be evacuated can be reduced remarkably. As a consequence the housing can be evacuated faster and a higher vacuum can be achieved. Thereby further the porosity of castings can be minimized.

According to a further aspect of the invention there is provided a heating device for melting a metal, the metal being taken up in the gas-tight housing within the crucible. By the proposed feature the step of pouring the melt into a cold crucible or gate, respectively, being accommodated within the rotor can be avoided. It is believed that this step is responsible for an undesirable cooling-down of the melt and therefore for the formation of cold-runs, hot tears, pores and the like.

According to an embodiment of the invention the auxiliary acceleration device comprises a flywheel and a clutch for drivingly connecting the flywheel with the shaft. By means of the proposed flywheel a high amount of rotational energy can be transferred within less than one second upon the rotor.

There may be provided a separate drive device for creating a rotational movement of the flywheel. According to an advantageous embodiment the flywheel is drivingly connected for creating a rotational movement thereof with the drive device provided for driving the shaft. In this case the clutch may be provided in the drive chain between the flywheel and the shaft. According to the proposed embodiment the drive device, which may comprise an electric motor, can either be used to create a rotational movement of the flywheel as well as for further accelerating and/or driving the rotor after the rotational energy of the flywheel has been transferred to the rotor.

According to a further embodiment of the invention the auxiliary acceleration device may comprise a jet propulsion. The jet propulsion may comprise at least one nozzle being mounted at the outer circumference of the rotor. Advantageously there are provided several nozzles at the outer circumference of the rotor. The jet propulsion may comprise a tank with pressurized gas to be expelled through at least one nozzle. According to an advantageous embodiment the at least one nozzle is mounted at an outer circumference of the rotor. The proposed jet propulsion may be used in combination with the proposed flywheel. Thereby a rapid acceleration of the rotor can be reached.

The auxiliary acceleration device may also comprise at least one pushing actuator for pushing the resting rotor. Such a pushing actuator comprises preferably a pneumatic driven pushing rod. If the rotor comprises several rotor arms there may be provided a pushing actuator nearby each of the rotor arms. A free end of the pushing actuator acts upon an outer circumferential section of the rotor and creates and immediate acceleration of the rotor. The pushing actuator may be advantageously combined with the aforementioned flywheel. The pushing actuator may be activated up to 0.3 seconds before the rotational energy from the flywheel is transferred to the rotor. Thereby the acceleration of the rotor can be improved remarkably.

A section of the gas-tight housing of the rotor in which the crucible is accommodated may be made of an material which is essentially transparent for electromagnetic fields. The material is preferably a ceramic, in particular alumina, or a glass, in particular silica-glass. The proposed materials allow for a melting of the metal by providing an induction heating nearby the section. According to a further embodiment the section being made of the essentially electrically isolating material protrudes from a base of the rotor or the base of a rotor arm, respectively.

According to a further embodiment the outlet opening/s of the crucible is/are arranged in a second radial distance from the axis. The second radial distance is greater than a diameter of the usually cylindrical shaped crucible. The second radial distance may be in the range of 300 to 500 mm, in particular in the range of 320 to 400 mm. The first radial distance, i.e. the distance between an inlet opening of the mold and the axis, is usually larger than the second radial distance. The difference between the first and the second radial may be 0 to 50 mm, preferably 0 to 10 mm.

By the proposed eccentrical arrangement of the crucible the centrifugal forces acting on the melt can be increased remarkably. By use of such an arrangement also the mold is arranged in a larger radial distance from the axis. Therefore the centrifugal force acting on the melt being forced into the mold can be increased. By this measure the formation of hot tears, hold runs and the like can be counteracted.

According to a further embodiment a heating device comprises an induction-coil. In this case it has been proven to advantageous to use a crucible being made of graphite or to accommodate within the crucible, which may be made of alumina, $Y_2O_3$ or the like, a further crucible being made of graphite. By using a crucible or a further crucible being made of graphite a fast melting of an ingot being taken up therein can be effected.

According to a further embodiment there may be provided a device for moving the induction-coil from a first position surrounding at least partly the crucible in a second position in which it does not interfere with a rotational path of movement of the crucible. This embodiment is directed in particular in an arrangement in which one or more separate crucibles are accommodated in the rotor in an eccentrical position. According to a further advantageous feature the induction-coil has an inner diameter which is larger than an outer diameter of the, preferably cylindrical shaped protrusion extending from the base of the rotor. This makes it possible to shift the induction-coil in a position in which it at least partly surrounds the protrusion in which the crucible is accommodated.

According to a further embodiment the crucible may also have the form of a ring-shaped channel being centrally accommodated in the rotor. Such a ring-shaped channel may have a plurality of outlet openings vis-à-vis the inlet openings of radially extending molds. The proposed ring-shaped crucible may be surrounded by induction-coil for heating ingots taken up therein.

BRIEF DESCRIPTION OF THE DRAWINGS

An exemplary embodiment of the object of the invention is explain in greater detail below on the basis of FIGS. 1 and 3.

DETAILED DESCRIPTION OF THE INVENTION

Figure 1:
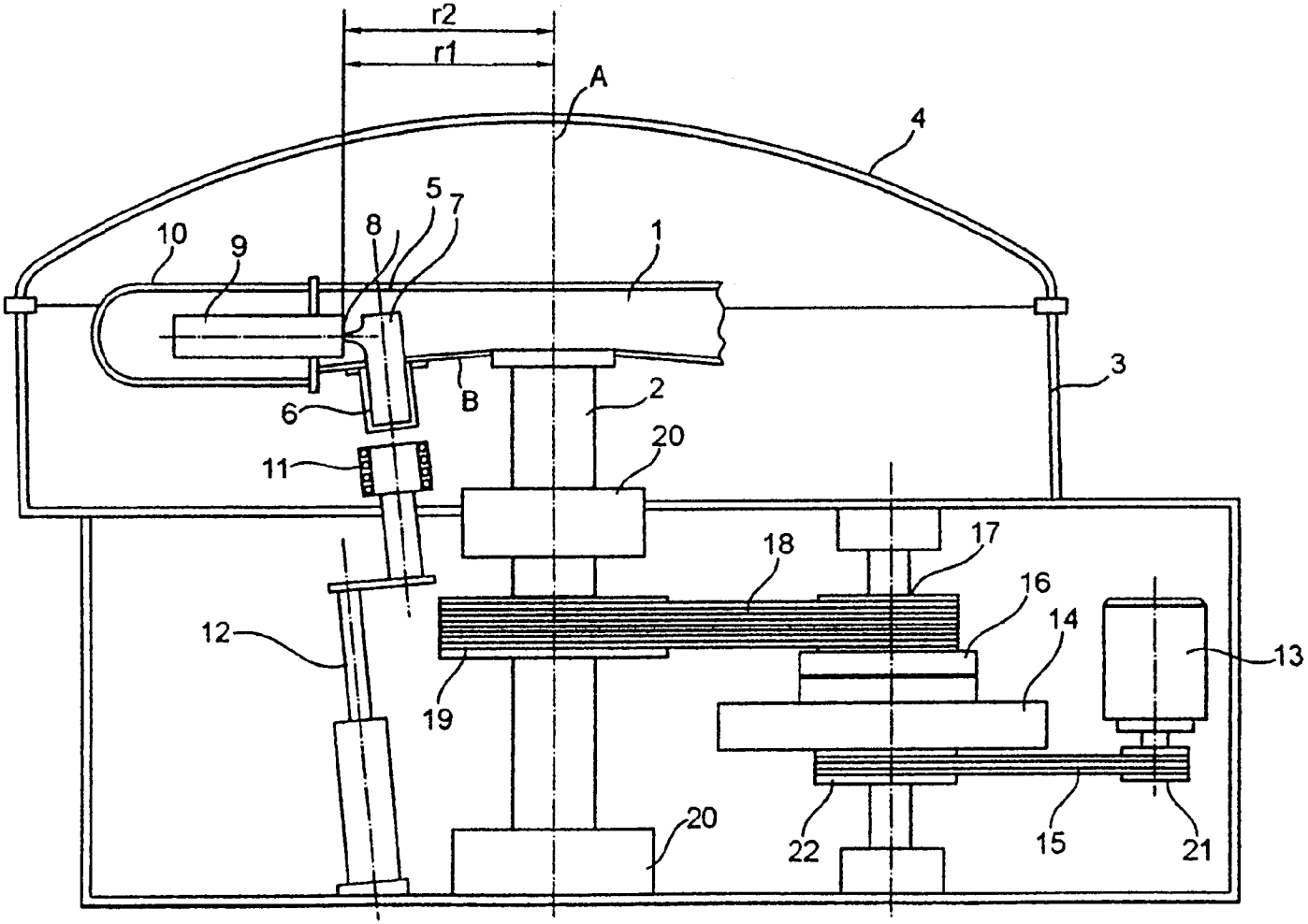
FIG. 1 shows a vertical cross section through essential parts of a first apparatus.

FIG. 1 shows a first apparatus for centrifugal casting. A rotor 1 has a shaft 2 which extends vertically therefrom. The shaft 2 is rotatable around an axis A. The rotor 1 is accommodated within a housing 3. A lid 4 of the housing 3 can be opened.

The rotor 1 may comprise several arms 5 which extend in a radial direction therefrom. In a bottom B of each arm 5 there is provided an opening which is sealed in gas-tight manner by a first crucible 6 extending the vertical direction from the bottom B. The first crucible 6 may be made of a heat resistant material like alumina, silica-glass or the like. Within the first crucible 6 there is accommodated a second crucible 7 which may be made again of a heat resistant material like alumina, $Y_2O_3$, magnesia and the like. The second crucible 7 also extends beyond the bottom B of the arm 2. The second crucible 7 has in an upper section thereof a radial outwardly protruding outlet opening 8 which is distanced from the axis A with a second radial distance r2.

A mold 9, which may be made of a ceramic material lined with $Y_2O_3$, is arranged vis-à-vis the outlet opening 8 of the second crucible 7 and extends in a radial direction therefrom. An inlet opening (not shown here) of the mold 9 is arranged opposite to the outlet opening 8. The inlet opening is distanced from the axis A with first radial distance r1. In the embodiment shown in FIG. 1 the first radial distance r1 is roughly the same as the second radial distance. However, it has be understood that the first radial distance r1 may be larger than the second radial distance r2. The mold 9 is covered by a piston 10 which can be releasably mounted at the arm 5 in gas-tight manner. The rotor 1 being sealed with the pistons 10 mounted at the arms 5 can form per se a gas-tight housing. This housing can be evacuated by a vacuum source (not shown here) which may be connected with the rotor 1 via the shaft 2. However, it is also possible to provide breakthroughs in the rotor 1 and to evacuate the housing 3 surrounding the rotor 1. In both cases it is possible to carry out the centrifugal casting process under vacuum. Alternatively, it is possible to carry out the centrifugal casting process under a shield gas, like Ar.

An induction-coil 11 is movable in an essentially vertical direction by a lifting device 12 so that the induction-coil 11 can selectively be lifted to surround the first crucible 6 as well as the second crucible 8 accommodated therein.—Within the second crucible 7 they may accommodated a third crucible (not shown here) which may be produced from a material which couples with induced currents. Such a material may be for example graphite. When using a third crucible the melting of an ingot taken up therein can be accelerated.

A drive chain comprises an electric motor 13 which is connected with a flywheel 14 by first V-belts 15. The flywheel 14 can selectively be connected by a clutch 16 with a first pulley 17. The first pulley 17 is drivingly connected by second V-belts 18 with a second pulley 19 being mounted on the shaft 2. Reference signs 20 designate bearings for rotatably supporting the shaft 2.

A first gear transmission ratio between a motor pulley 21 and a flywheel pulley 22 is around 1:2.5. A second gear transmission ratio between the first pulley 17 and the second pulley 19 is around 1:1.4. It has to be understood that the gear transmission ratio can be adapted in accordance with the power of the used electric motor 13, the radius and the mass of the rotor 1.

The function of the first apparatus for centrifugal casting is as follows:

The driving chain is disconnected by means of the clutch 16. Then the flywheel 14 is driven by means of the electric motor 13 until a high rotational speed is achieved. At the same time an ingot consisting of a γ-titanium aluminide which may have in at. % the following composition:

$$Ti_{45-52}Al_{45-48}X1_{1-3}X2_{2-4}X3_{1},$$

where

X1=Cr, Mn, V

X2=Nb, Ta, W, Mo

X3=Si, B, C.

For example, the titanium aluminide alloy may contain 30 to 45 wt. % Al, 4 to 6 wt. % Nb and as balance Ti as well as unavoidable impurities. Further, the alloy may contain one or more of the following constituents: 0.5 to 3.0 wt. % Mn, 0.1 to 0.5 wt. % B, 1.5 to 3.5 wt. % Cr. Further, the titanium aluminide alloy may contain O in an amount of 0 to 1000 ppm, C in an amount of 0 to 1000 ppm, preferably 800 to 1200 ppm, Ni in an amount of 100 to 1000 ppm and N in an amount of 0 to 1000 ppm.

An ingot of the aforementioned composition is melt by means of the induction heating. During the heating process the induction-coil 11 is in a lifted-up position surrounding the first 6 and second crucible 8. As soon as the ingot has been molten the induction-coil 11 is brought into a lower position in which it does not interfere with the first crucible 6 extending from the bottom B of the rotor 1. Then by means of the clutch 16 the rotational energy saved by the flywheel 14 is transmitted upon the rotor 1. The rotor 1 is accelerated with a high speed. The centrifugal force acting on the melt being taken up in the second crucible 8 forces the melt into the mold 9.

Figure 2:
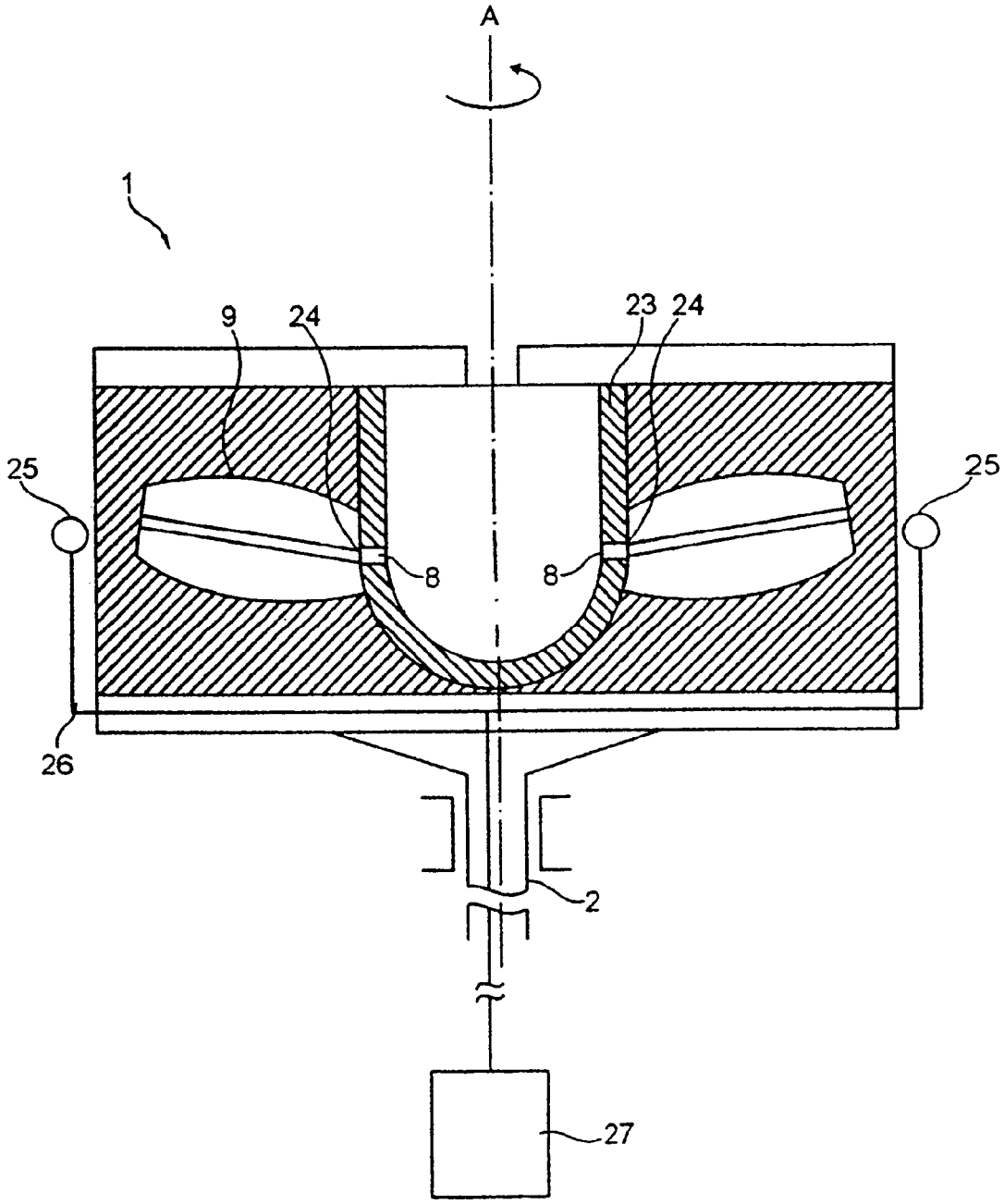
FIG. 2 shows a vertical cross section through essential parts of a second apparatus.

FIG. 2 shows a second apparatus for centrifugal casting. In contrast to the first apparatus there is accommodated a fourth crucible 23 in a centrical position relative to the axis A. Outlet openings of the fourth crucible 23 are designated by reference signs 8. The fourth crucible 23 may be made of alumina, graphite, $Y_2O_3$ and the like. In order to melt an ingot being taken up in the fourth crucible 23 it may be surrounded by an induction-coil (not shown here). Vis-à-vis the outlet openings 8 there are mounted molds 9 with their inlet openings 24 being located opposite the outlet openings 8. At the outer circumference of the rotor 1 there are provided nozzles 25 which are connected via a pressure air line 26 with a pressure air supply tank 27.

The function of the second apparatus for centrifugal casting is as follows:

An ingot taken up in the fourth crucible 23 is molten by an induction heating (not shown here) which is part of the rotor 1. As soon as the melt has been created a valve (not shown here) interrupting the pressure air line 26 is opened so that the nozzles 25 are pressurized. The back stroke created by the nozzles 25 rapidly accelerates the rotor 1. Again the melt being taken up in the fourth crucible 23 is forced by centrifugal forces into the molds 9.

The auxiliary acceleration devices described in the first and second apparatuses can be combined in order to achieve a further enhanced acceleration of the rotor 1.

Figure 3:
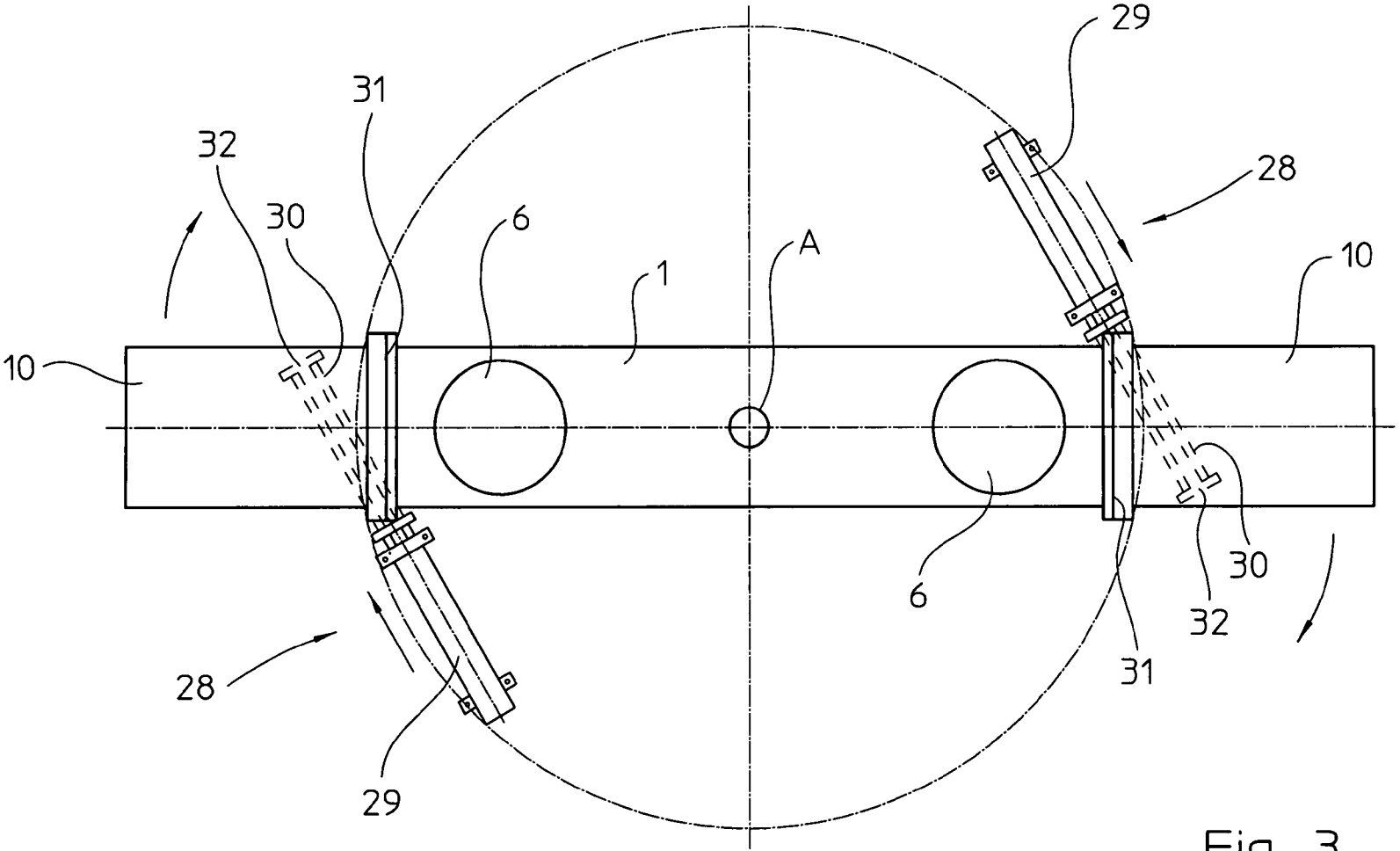
FIG. 3 shows a schematic plan view of a third apparatus.
Figure 4:
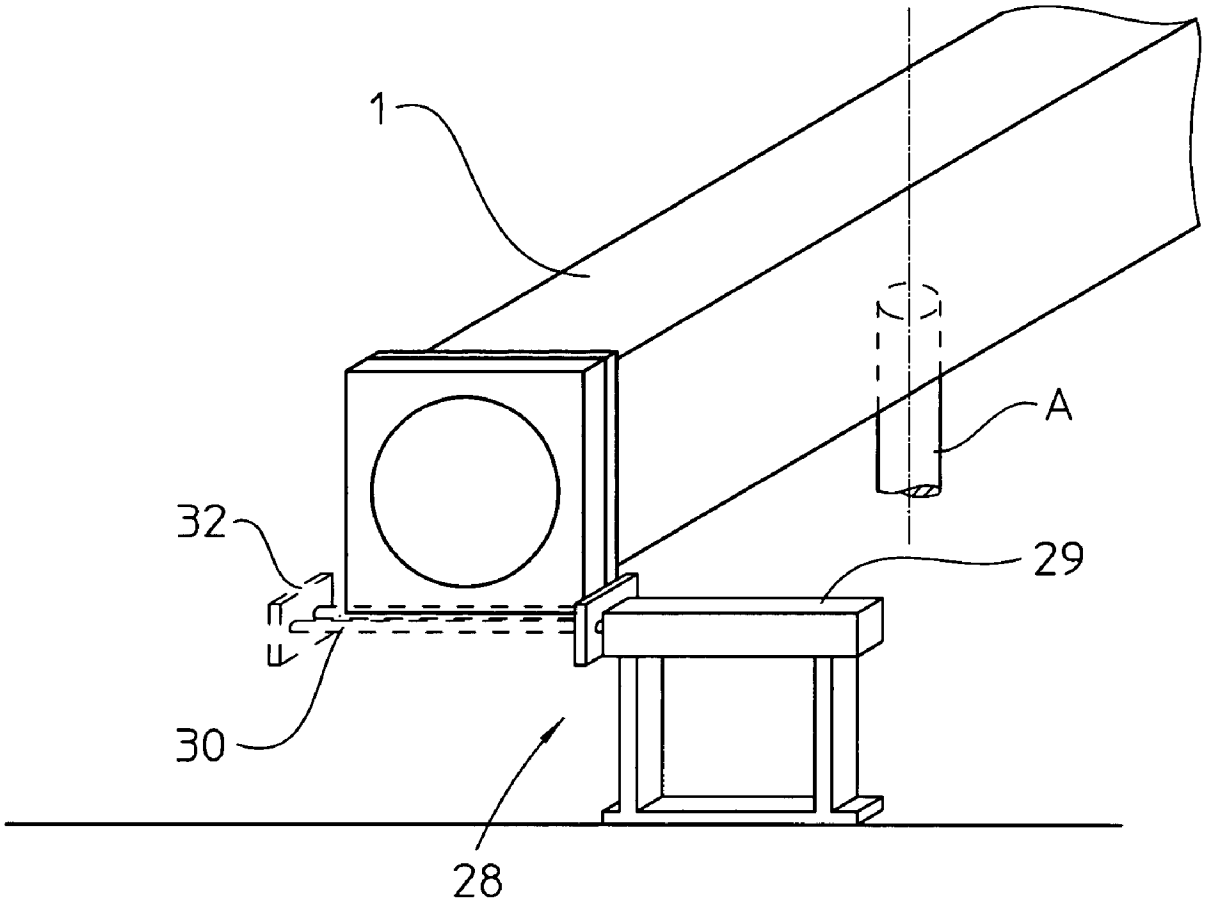
FIG. 4 shows a perspective view of a pushing actuator according to FIG. 4

FIGS. 3 and 4 show views of a third apparatus. There are provided two pneumatic pushing actuators 28 each of which comprises a piston 29 and a pushing rod 30 being guided within the piston 29. Both pistons 29 are connected with a joint air line (not shown here) which is connected via a valve with a source of compressed air (not shown here).

A free end of the pushing rod 30 is disposed such that it may abut, e.g. against a flange 31 at which each piston 10 mounted. As can be seen from FIG. 4 the pushing actuator 28 is disposed in a plane below a rotational plane of the rotor 1. However, the free end of the pushing rod 30 interferes in a retracted state with a lower portion of the flange 31. The pushing rod 30 and its free end does not interfere with the flange 31, the rotor 1 or the piston 10 in an extended state. This can be achieved, as can be seen from FIG. 4, by disposing the pushing actuator 28 such that the free end of the pushing rod 30 stops in its extended state at a radial outer position compared to the radius of the flange 31. In order to avoid an interference in the extended state of the pushing rod 30 there is provided at its free end a pushing plate 32, a height or a diameter of which is larger than the diameter of the pushing rod 30. A difference in height or diameter between the pushing rod 30 and the pushing plate 32 is chosen such that it is larger than a projecting length of the flange 31. Further a length of the pushing rod 30 in the extended state is chosen such that no interference can occur between the flange 31 and the pushing plate 32.

The auxiliary acceleration device shown in FIGS. 3 and 4 may be combined with the auxiliary acceleration device comprising the flywheel 14. At an initial state the pushing plates 32 of the pushing actuators 28 abut against a lower portion of the flange 31. Upon opening of the vent both pistons 39 are pressurized immediately with a high air pressure by which the pushing rod 30 is forced with a high speed from its retracted state into its extended state. The rotor 1 is accelerated immediately. E.g. 0.1 to 0.3 seconds after the vent has been opened a rotational energy saved by the flywheel 14 is additionally transmitted by means of the clutch 16 on the rotor 1. Thereby an extreme high acceleration of the rotor 1 can be achieved.

It has to be understood that the pushing actuator 28 not necessarily has to be driven by compressed air. It is also possible to drive the pushing actuator 28 from example by a spring, by hydraulic means, by blasting agents or by other means by which a high energy can be transferred within a short time.

Figure 5:
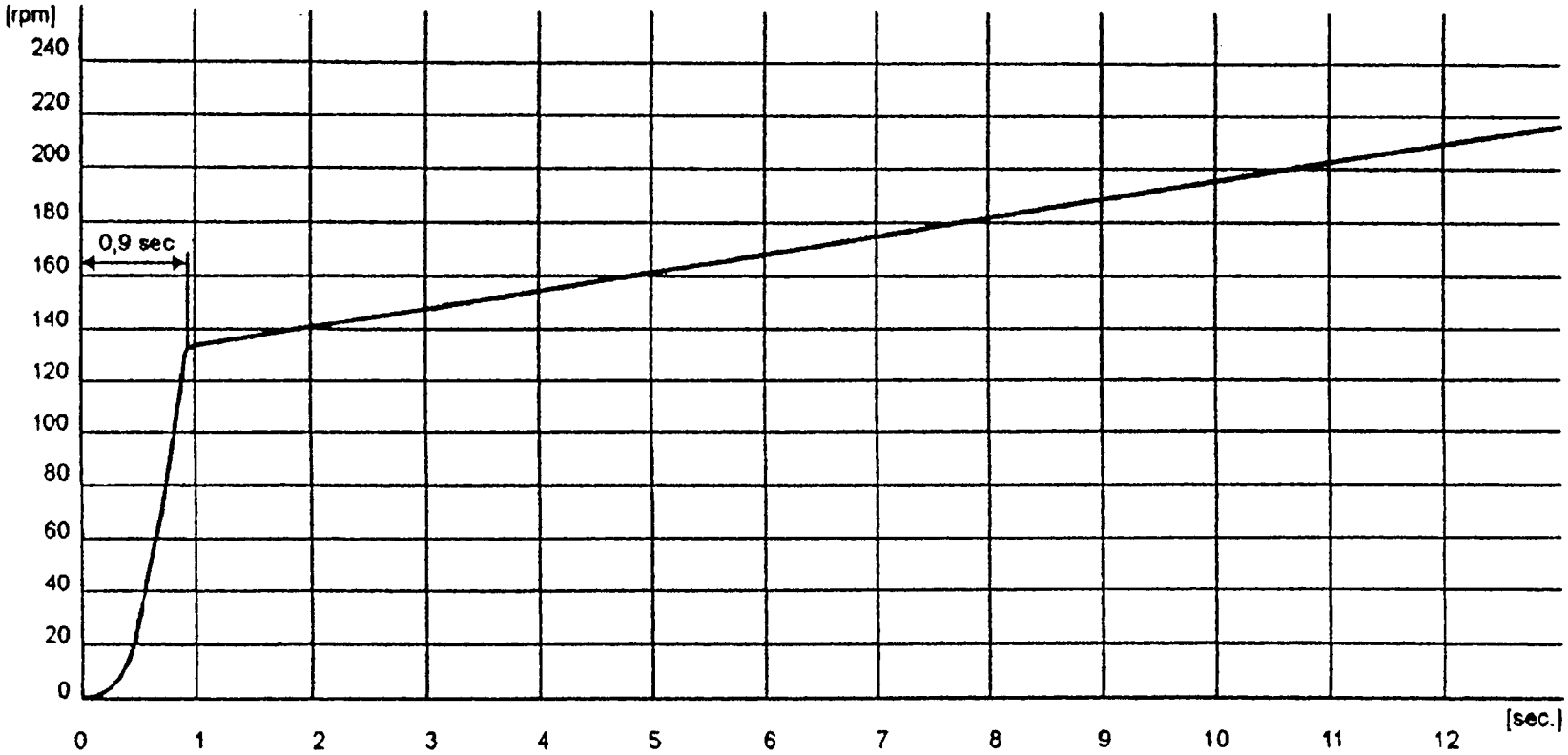
FIG. 5 shows a plot of the rotational speed of the first apparatus over the time.

FIG. 5 shows a plot of the rotational speed of the rotor of the first apparatus above the time. From this plot one can see that in less than one second the rotor 1 of the first apparatus can be accelerated on a speed of around 140 rpm. This initial acceleration is essentially created by a transfer of the rotational energy from the auxiliary acceleration device, e.g. flywheel 14, to the rotor 1. Afterwards, the rotor 1 is accelerated at a lower rate of acceleration by the effect of the electric motor 13.—Although it is not shown in FIG. 3 it has to be understood that with the proposed apparatus the rotor can be rotated at a constant rotational speed after first period of high acceleration and the subsequent period of lower acceleration. There may be provided a control equipment by which the period of constant rotational speed may be limited to 1 to 6 minutes, preferably to 4 to 6 minutes. Afterwards the movement of the rotor may be stopped. By the control equipment the movement of the rotor may be controlled automatically.

By the proposed auxiliary acceleration device it is possible to rapidly force the melt from a second crucible 7 or a fourth crucible 23 into the mold 9. In particular the melt immediately can be forced into the mold 9 after it has reached a predetermined temperature. An undesirable cooling-down of the melt, which for example is created when a metal melt is poured from further crucible being located outside the rotor 1 into a second 7 or fourth crucible 23 being accommodated in the rotor 1 is avoided. Furthermore, an evaporation of volatile constituents of a metal alloy can be minimized.

The invention claimed is:

1. An apparatus for centrifugal casting under vacuum, said apparatus comprising:

a rotor having a shaft extending in an essentially vertical direction therefrom and being rotatable around an axis defined by the shaft, the rotor having at least one mold releaseably fixed thereto at a first radial distance from the axis, and at least one crucible associated with the mold so that an outlet opening of the crucible is arranged opposite an inlet opening of the mold, and the rotor further comprising a gas-tight housing in which the mold and the crucible are accommodated, a vacuum source to create a vacuum in the housing, a heating device that melts a metal, the metal being taken up in the gas-tight housing within in the crucible, a drive device that drives the shaft in order to rotate the rotor, and an auxiliary acceleration device configured to generate a force to initiate the rotation of the rotor to overcome a moment of inertia of the rotor, the auxiliary acceleration device comprising jet propulsion and/or at least one pushing actuator accelerating the resting rotor.

2. The apparatus of claim 1, wherein the auxiliary acceleration device further comprises a flywheel and a clutch drivingly connecting the flywheel with the shaft.

3. The apparatus of claim 2, wherein the flywheel is drivingly connected to create a rotational movement thereof with the drive device provided for driving the shaft.

4. The apparatus of claim 3, wherein the clutch is provided in a drive chain between the flywheel and the shaft.

5. The apparatus of claim 1, wherein the drive device comprises an electric motor.

6. The apparatus of claim 1, wherein the jet propulsion comprises at least one nozzle mounted at the outer circumference of the rotor.

7. The apparatus of claim 6, wherein the jet propulsion comprises a tank with pressurized gas to be expelled through the at least one nozzle.

8. The apparatus of claim 1, wherein the pushing actuator comprises a pneumatic driven pushing rod.

9. The apparatus of claim 1, wherein a section of the gas-tight housing in which the crucible is accommodated is made of a material, which is essentially transparent for electromagnetic fields.

10. The apparatus of claim 9, wherein the material is a ceramic or a glass.

11. The apparatus of claim 1, wherein the shaft is hollow and wherein the vacuum source is connected with the housing through the shaft.

12. The apparatus of claim 1, wherein the outlet opening of the crucible is arranged in a second radial distance from the axis.

13. The apparatus of claim 12, wherein the second radial distance is larger than a diameter of the crucible.

14. The apparatus of claim 1, wherein the heating device comprises an induction-coil.

15. The apparatus of claim 14, further comprising a moving device configured to move the induction-coil from a first position surrounding at least partly the crucible to a second position in which it does not interfere with a rotational path of movement of the crucible.

* * * * *